US008894420B2

(12) United States Patent
Schichl et al.

(10) Patent No.: US 8,894,420 B2
(45) Date of Patent: Nov. 25, 2014

(54) ELECTRICAL CONNECTION APPARATUS

(75) Inventors: Markus Schichl, Seekirchen (AT); Folke Michelmann, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 13/696,829

(22) PCT Filed: May 3, 2011

(86) PCT No.: PCT/EP2011/057024

§ 371 (c)(1), (2), (4) Date: Nov. 8, 2012

(87) PCT Pub. No.: WO2011/141328

PCT Pub. Date: Nov. 17, 2011

(65) Prior Publication Data

US 2013/0065407 A1 Mar. 14, 2013

(30) Foreign Application Priority Data

May 10, 2010 (DE) ..... 10 2010 028 791

(51) Int. Cl.

| | |
|---|---|
| ***H01R 11/30*** | (2006.01) |
| ***H01R 13/62*** | (2006.01) |
| ***H01R 13/58*** | (2006.01) |
| *H01R 13/56* | (2006.01) |

(52) U.S. Cl.

CPC ..... *H01R 13/6205* (2013.01); *H01R 13/5841* (2013.01); *H01R 2201/12* (2013.01); *H01R 13/562* (2013.01)

USPC ..... 439/39

(58) Field of Classification Search

CPC ..... H01R 13/6205; H01R 11/30

USPC ..... 439/38–40

See application file for complete search history.

(56) References Cited

U.S. PATENT DOCUMENTS

| | | | | | |
|---|---|---|---|---|---|
| 4,874,316 | A | * | 10/1989 | Kamon et al. | 439/39 |
| 5,380,219 | A | * | 1/1995 | Klier | 439/446 |
| 5,735,707 | A | * | 4/1998 | O'Groske et al. | 439/446 |
| 5,829,987 | A | * | 11/1998 | Fritsch et al. | 439/38 |
| 5,941,729 | A | * | 8/1999 | Sri-Jayantha | 439/505 |
| 5,954,520 | A | * | 9/1999 | Schmidt | 439/39 |
| 6,406,314 | B1 | * | 6/2002 | Byrne | 439/215 |
| 6,623,276 | B2 | * | 9/2003 | Dalmau Ferrerfabrega et al. | 439/39 |
| 6,695,620 | B1 | * | 2/2004 | Huang | 439/11 |
| 6,840,795 | B1 | * | 1/2005 | Takeda et al. | 439/492 |

(Continued)

FOREIGN PATENT DOCUMENTS

| | | | |
|---|---|---|---|
| DE | 101 49 575 | A1 | 5/2003 |
| DE | 20 2006 020 263 | U1 | 2/2008 |
| EP | 1 865 581 | A2 | 12/2007 |
| GB | 898067 | A | 6/1962 |

*Primary Examiner* — Ross Gushi

(74) *Attorney, Agent, or Firm* — GrayRobinson, PA

(57) ABSTRACT

An electrical connection system includes a plug having contact elements, and a socket having mating contact elements. The plug can be connected magnetically to the socket by means of a magnet device for transmitting signals or current. The magnet device has at least one connection pair, which comprises a magnet and a connecting element, which can be attracted by the magnet, but itself is not in the form of a permanent magnet, wherein respectively the magnet of a connection pair is arranged in the socket, and the connecting element which is not in the form of a permanent magnet is arranged in the plug.

7 Claims, 3 Drawing Sheets

(56) References Cited

U.S. PATENT DOCUMENTS

| | | | | |
|---|---|---|---|---|
| 6,966,781 | B1 * | 11/2005 | Bullinger et al. | 439/38 |
| 7,056,127 | B2 * | 6/2006 | Suzuki et al. | 439/39 |
| 7,234,963 | B1 * | 6/2007 | Huang | 439/446 |
| 7,341,458 | B1 * | 3/2008 | Koh | 439/39 |
| 7,364,433 | B2 * | 4/2008 | Neidlein | 439/66 |
| 7,507,108 | B2 * | 3/2009 | Tsuji | 439/446 |
| 7,614,903 | B1 * | 11/2009 | Huang | 439/446 |
| 7,658,613 | B1 * | 2/2010 | Griffin et al. | 439/39 |
| 7,828,555 | B1 * | 11/2010 | Huang | 439/6 |
| 8,371,872 | B2 * | 2/2013 | Zhou | 439/446 |
| 2002/0086559 | A1 * | 7/2002 | Dalmau Ferrerfabrega et al. | 439/39 |
| 2004/0209489 | A1 * | 10/2004 | Clapper | 439/39 |
| 2005/0255719 | A1 * | 11/2005 | Heidlein | 439/39 |
| 2007/0072442 | A1 * | 3/2007 | DiFonzo et al. | 439/39 |
| 2007/0072443 | A1 * | 3/2007 | Rohrbach et al. | 439/39 |
| 2007/0161262 | A1 * | 7/2007 | Lloyd | 439/39 |
| 2008/0280461 | A1 * | 11/2008 | DiFonzo et al. | 439/39 |
| 2009/0117783 | A1 * | 5/2009 | Wu | 439/660 |
| 2009/0181556 | A1 * | 7/2009 | Rohrbach et al. | 439/39 |
| 2010/0035441 | A1 * | 2/2010 | Rohrbach et al. | 439/39 |
| 2010/0087071 | A1 * | 4/2010 | DiFonzo et al. | 439/39 |
| 2012/0143062 | A1 * | 6/2012 | Nordgren et al. | 600/459 |
| 2012/0178271 | A1 * | 7/2012 | Rohrbach et al. | 439/39 |
| 2013/0065406 | A1 * | 3/2013 | Rohrbach et al. | 439/39 |
| 2013/0065407 | A1 * | 3/2013 | Schichl et al. | 439/39 |
| 2013/0143419 | A1 * | 6/2013 | Wei et al. | 439/39 |
| 2013/0295781 | A1 * | 11/2013 | Gualino et al. | 439/39 |
| 2013/0316549 | A1 * | 11/2013 | DiFonzo et al. | 439/39 |
| 2013/0344707 | A1 * | 12/2013 | Kiani et al. | 439/39 |
| 2013/0344708 | A1 * | 12/2013 | Kiani et al. | 439/39 |
| 2014/0024227 | A1 * | 1/2014 | Umeno | 439/39 |

* cited by examiner

ELECTRICAL CONNECTION APPARATUS

CROSS REFERENCE TO RELATED APPLICATIONS

This application claims priority under 35 U.S.C. Sections 119(a)-(d), 120, 363, and 365 to International Patent Application No. PCT/EP2011/057024, filed May 3, 2011 which designated the United States and at least one other country in addition to the United States and claimed priority to German Application No. 10 2010 028 791.1, filed May 10, 2010. Both PCT/EP2011/057024 and German Application No. 10 2010 028 791.1 are expressly incorporated by reference herein in their entirety to form a part of the present disclosure.

FIELD OF THE INVENTION

The invention relates to the field of electrical connection apparatus having a plug which has contact elements, and having a socket which has mating contact elements.

BACKGROUND OF THE INVENTION

An electrical connection system of this generic type is known from DE 20 2006 020 263 U1. Connection systems such as these are used to transmit current, data and/or signals, and for this purpose generally have a multiplicity of contact elements which, when the connection system is mated, are connected to corresponding mating contact elements. The contact elements may be arranged in a plug, and the mating contact elements may be arranged in a socket.

Magnets which are aligned with one another are inserted in the plug and the socket, in order to make a good contact between the contact elements and the mating contact elements. The magnets in the plug and in the socket in this case attract one another and ensure that the plug is mechanically connected to the socket and that, in the process, the contact elements make contact with the mating contact elements. In general, two magnets are in each case provided in the plug, and two magnets in the socket.

Additionally or alternatively to the use of magnets and corresponding opposing magnets, it is also known from the general prior art for so-called contact links, for example a silicone cushion, to be used in order to elastically prestress the contact elements in the direction of the mating contact elements.

The use of magnets and opposing magnets has been found to be particularly suitable on the one hand for making a reliable connection between the contact elements and the mating contact elements, and on the other hand to simplify the connection process. Within certain limits, connection systems such as these may be self-locating.

The use of magnets to make a good contact in electrical connection systems, particularly with respect to the contact between a plug and a socket, is suitable for many applications. However, applications are known, in particular in medical care facilities and in hospitals, in which the use of magnets is impossible, since situations can arise there in which the magnets interfere with medical units which are important to life, for example heart pacemakers implanted in the patients.

In this case, it is particularly problematic if, for example, a plug becomes detached from a socket as a result of an accidental pulling or bending load, and falls onto the chest of a patient, thus having a negative influence on an implanted heart pacemaker.

SUMMARY OF THE INVENTION

The present invention is therefore based on the object of further developing an electrical connection system having a plug, which has contact elements, and having a socket, which has mating contact elements, such that a magnet device for connecting the plug to the socket magnetically can be used even in sensitive areas, in particular in medical care facilities.

With regard to the electrical connection system, this object is achieved in that the magnet device has at least one pair of connections which comprise a magnet and a connection element which can be attracted by the magnet but is not itself permanently magnetic, wherein the magnet on each pair of connections is arranged in the socket, and the connection element which is not permanently magnetic is arranged in the plug.

Since the magnet device has at least one pair of connections which comprise a magnet and a connection element which is not permanently magnetic, and since the connection element which is not permanently magnetic is arranged in the plug, the advantages of a magnetic device for making a connection between a plug and a socket can be achieved even in sensitive areas, in particular in medical care facilities, in particular in hospitals. The solution according to the invention means that the plug no longer has a magnet and the plug has no permanently magnetic material which produces a magnetic field which could interfere with medical units, components and other electrical appliances, in particular medical electrical appliances which are important to life. If the plug falls onto the chest of a patient, there is no negative influence from the magnetic field on, for example, an implanted heart pacemaker. At the same time, the solution according to the invention makes it possible to exploit all the advantages of a magnetic connection between a plug and socket.

The connection between the plug and socket can be made easily because of the magnet device, and in this case the magnet device can assist exact positioning of the plug with respect to the socket. Furthermore, the magnet device makes it possible to automatically release the connection between the plug and the socket as soon as a pulling load or bending load which exceeds a defined level is applied to the plug. This measure can be controlled by the strength of the magnet device. In conventional plug connectors, when a pulling or bending load is inadvertently applied to the plug, this can be pulled out of the socket, causing mechanical damage there. Furthermore, there is a risk of an inadvertent pulling or bending load on the plug leading to the appliance itself being pulled out of its anchorage or off its rest and, for example, falling down, possibly even onto the patient.

The use of a magnetic connection between a plug and a socket therefore reduces damage to the appliances provided with the socket, and reduces the risk of injury to the patient.

For the purposes of the invention, a "connection element which is not permanently magnetic" means that this connection element is not a long-term or permanent magnet. It should be noted that materials which can be attracted magnetically normally lose the vast majority of their magnetization immediately when the material is removed from the external magnetic field, in the present case the magnetic field of the magnet in the socket. In general, only a small amount of residual magnetism remains, the so-called remanance. However, there are also materials in which this remanance is quite high, and long-term, permanently strong magnetization is achieved. Materials such as these can be magnetized to form permanent magnets, or exist from the start as permanent magnets, that is to say they permanently assume a clearly identifiable (microscopic) magnetization. This is not desirable for the purposes of the invention, and therefore materials which have remanance after they have been removed from the magnetic field of the magnet in the socket, which remanance corresponds to long-term (permanent) strong magnetization, are covered by the term permanent magnets, and not by the feature "connection element which is not permanently magnetic".

The scope of the invention essentially covers a plug which is accidentally or deliberately removed from a socket not representing any risk to the patient or electrical, medical appliances and components, such as heart pacemakers. The invention therefore provides that the plug has a connection element which, although it can be attracted magnetically is not, however, itself permanently magnetic, and its remanance is sufficiently low that no risk results from this.

It is advantageous for the connection element which is not permanently magnetic to be a soft-magnetic material. Soft-magnetic materials become non-magnetic again when the magnet is removed (possibly apart from a small amount of remanance). In contrast to this, hard-magnetic materials remain magnetic when they have been arranged for a long time adjacent to a magnet.

It is advantageous for the connection element which is not permanently magnetic to be formed by a soft-iron core.

In general, the connection element which is not permanently magnetic may consist, for example of iron, cobalt, nickel, gadolinium, terbium, dysprosium or of suitable alloys or compounds which satisfy the characteristic of having no long-term, permanent, strong magnetization after removal from the magnetic field, even they have been arranged in an external magnetic field for a relatively long time.

It is advantageous for the magnet device to have two or more pairs of connections. Provision of at least two pairs of connections has been found to be particularly advantageous, in order to achieve exact positioning of the plug with respect to the socket.

It is advantageous if the plug and the socket can be connected to one another exclusively by the magnet device. This means that is advantageous if the connection between the plug and the socket is produced only by the magnet device, that is to say no additional mechanical connection, for example a plug connection, is provided. This allows the plug to be connected to the socket, and removed from it, easily. This also ensures that the plug itself will be detached from the socket if misused, without damaging the socket or the appliance.

It is advantageous for the contact elements to be inserted into the plug such that their contact surfaces are arranged essentially on a plane with a front face, facing the socket, of the plug, and the mating contact elements are inserted into the socket such that their mating contact surfaces are arranged essentially flush on a plane with a front face, facing the plug, of the socket, with the contact elements and the mating contact elements making contact over an area by means of their mutually aligned contact surfaces and mating contact surfaces, when the plug is magnetically connected to the socket.

This refinement has been found to be particularly appropriate, in particular because the magnet device allows a reliable contact to be made. The plug can be connected to the socket, and removed again, in a simple manner. The wording "essentially on a plane" should in this case also be understood as meaning that the contact surfaces and/or the mating contact surfaces project slightly beyond the plane of the front face of the plug or of the socket, or are slightly recessed or set back. In this case, in particular, it is possible for the contact surfaces in the front face of the plug to be slightly recessed, and for the mating contact surfaces to project slightly beyond the front face of the socket, such that the mating contact surfaces in each case enter the contact surfaces of associated depressions in the front face of the plug, when the socket is connected to the plug. A depression such as this may, for example, be 1 to 3 mm. This makes it possible to achieve an improved connection between the contact surfaces of the contact elements and the mating contact surfaces of the mating contact elements. This provides mechanical guidance for the mating contact elements. At the same time, this does not result in any mechanical connection between the plug as an entity and the socket as an entity which could be damaged in the event of an inadvertent pulling or bending load on the plug.

It is, of course, also possible for the contact surfaces of the contact elements to project slightly beyond the front face of the plug and, in a corresponding analogous manner, for the mating contact surfaces of the mating contact elements to be recessed or set back slightly into the front face of the socket. The two solutions are equivalent.

It may also be advantageous for the plug and the socket to have a so-called mechanical coding which ensures in a known manner that the plug can be placed on the socket, and can be connected too, in only one position. By way of example, the mechanical coding can be provided by a projection in the socket or the plug, which engages in a corresponding recess in the plug or the socket.

It is advantageous for the magnets in the socket and/or the connection element which is not permanently magnetic to be held in the plug by adhesive bonding, clamps or clips. This allows the magnet and/or the connection element which is not permanently magnetic to be arranged and fitted particularly easily.

It is advantageous for the socket to be integrated in an electronic component or an electronic appliance, in particular a medical appliance.

It is also advantageous for the plug to have a ball joint and/or a rotating joint and/or a hinge, via which a cable outlet is connected such that it can move to a housing of the plug.

It is known from the general prior art to provide so-called kink protection for plugs, that is to say for the plug to have cable kink protection in the area of the cable outlet, which prevents pulling or bending loads which act on the cable or the cable outlet from being transmitted into the interior of the cable such that damage occurs there. By way of example, cable kink protection such as this can be provided by mechanical projections and/or recesses in the area of the cable outlet in the plug housing, which correspond to correspondingly complementary recesses and/or projections in the area of the outside of the cable outlet, as a result of which a preferably interlocking mechanical connection is made between the cable outlet and an area of the plug which surrounds the cable outlet.

In one advantageous further development of the present invention, the inventors have identified that inadvertent disconnection of the plug from the socket can be reduced by the plug having a ball joint and/or a rotating joint and/or a hinge, via which the cable outlet is connected, such that it can move, to the housing of the plug. This means that the ball joint and/or the rotating joint and/or the hinge is moved first of all when a pulling or bending load is applied to the cable or the cable outlet. In consequence, initially, no force is transmitted to the plug or the connection between the plug and the socket. Only when the ball joint, the rotating joint or the hinge has reached an end stop and cannot rotated/move any further is a pulling or bending load on the cable or cable outlet transmitted to the plug or the connection between the plug and the socket. The provision of a ball joint and/or a rotating joint and/or a hinge makes it possible to at least partially absorb forces that occur, thus reducing the risk of inadvertent disconnection of the plug.

This refinement therefore means that the cable can first of all move with respect to the plug, before the pulling or bending load acts on the magnetic connection. In contrast to this, a bending or pulling load which acts on a cable outlet or a cable is transmitted immediately to the magnetic connection when only a kink protection sleeve is provided, that is say there is a firm mechanical connection between the cable outlet and the plug.

According to the invention, it is also possible to use plugs for an electrical connection system as a replacement or accessory. In this case, it is likewise advantageous for the plug to have a ball joint and/or a rotating joint and/or a hinge, which connects a cable outlet such that it can move to a housing of the plug.

It is advantageous for an electronic component or electronic appliance, particularly for medical applications, to be equipped with a socket as part of an electrical connection system. In this case, the socket can be integrated in the appliance in a known manner. According to the invention, it is also possible in this case for the electronic component or electronic appliance to be provided with a plurality of sockets according to the invention.

The use of an electrical connection system for connection of a plug to a socket is particularly suitable for electronic, medical components or electronic, medical appliances which are used in medical care facilities, in particular in hospitals. However, the invention is not restricted to this. Other areas which react sensitively to magnetic fields are also known, in which it may be advantageous to use the electrical connection system according to the invention, for example in aircraft or in space flight.

BRIEF DESCRIPTION OF THE DRAWINGS

One exemplary embodiment of the invention will be described in the following text with reference to the drawing, in which.

DETAILED DESCRIPTION OF THE INVENTION

In principle, electrical connection systems are already known from the general prior art, in which context reference is made, for example, to DE 20 2006 020 263 U1. Electrical connection systems are particularly suitable for transmission of signals, data or current. Only those features which are essential to the invention will be described in more detail in the following text.

Figure 1:
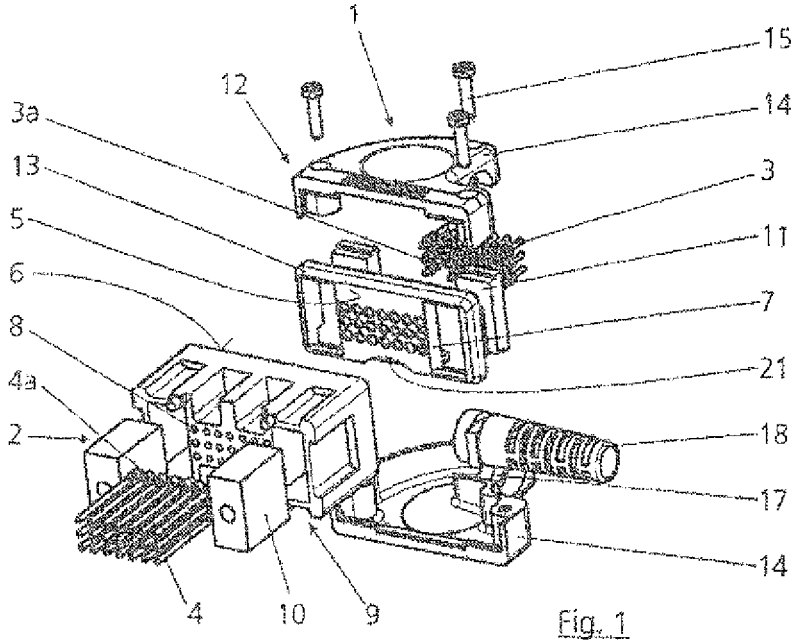
FIG. 1 shows a perspective illustration of the electrical connection system with a plug and a socket, in the form of an exploded illustration.

FIG. 1 shows an electrical connection system having a plug 1 and a socket 2. The plug 1 in this case has a plurality of contact elements 3, and the socket 2 has a corresponding number of mating contact elements 4. The contact elements 3 are inserted in the plug 1 such that their contact surfaces 3*a* are arranged essentially on a plane with a front face 5, facing the socket 2, of the plug 1. The mating contact elements 4 are inserted analogously in the socket 2 such that their mating contact surfaces 4*a* are arranged essentially flush on a plane with a front face 6, facing the plug 1, of the socket 2.

In the exemplary embodiment, the contact elements 3 and the mating contact elements 4 are inserted into corresponding holes 7 and 8, respectively, in the plug 1 and the socket 2, which respectively pass through the front face 5 of the plug 1 or the front face 6 of the socket 2, such that the contact surfaces 3*a* and mating contact surfaces 4*a*, respectively, can be accessed to make an area contact. In this case, the front ends of the contact elements 3 and of the mating contact elements 4, respectively, which respectively comprise the contact surfaces 3*a* and the mating contact surfaces 4*a*, may be thickened and/or provided with barbs such that they remain in the respective holes 7 and 8 in the plug 1 and the socket 2 once they have been inserted there.

As is also evident from the exemplary embodiment, a magnet device 9 is provided, which mechanically connects the plug 1 to the socket 2. For this purpose, the magnet device 9 in the exemplary embodiment has two pairs of connections which are in each case composed of a magnet 10 and a connection element 11, which can be attracted by the magnet 10 but is not itself permanently magnetic. In this case, the magnet 10 of a pair of connections is arranged in the socket 2, and the connection element 11, which is not permanently magnetic, of the pair of connections is arranged in the plug 1. In the exemplary embodiment, the socket 2 therefore has two magnets 10, and the plug 1 has two connection elements 11 which are not permanently magnetic.

In the exemplary embodiment, the respective front faces 5 and 6 of the plug 1 and of the socket 2 are in the form of an elongated rectangle, with the longitudinal faces of the rectangle preferably being 2 to 3 times the length of the short sides of the rectangle. In this case, it is advantageous for the magnets 10 and, analogously, the connection elements 11 each to be arranged in the area of the short sides of the rectangle which is formed by the respective front faces 5 and 6. This provides particularly good assistance to automatic alignment of the plug 1 with respect to the socket 2 when they are intended to be mated.

In the exemplary embodiment, the plug 1 and the socket 2 can be or are connected to one another exclusively by the magnet device 9, that is to say no additional mechanical connection elements are provided. In particular, there is no intention of the plug and the socket being connected in a mechanically interlocking manner, for example by being plugged in or gripped.

Figure 2:
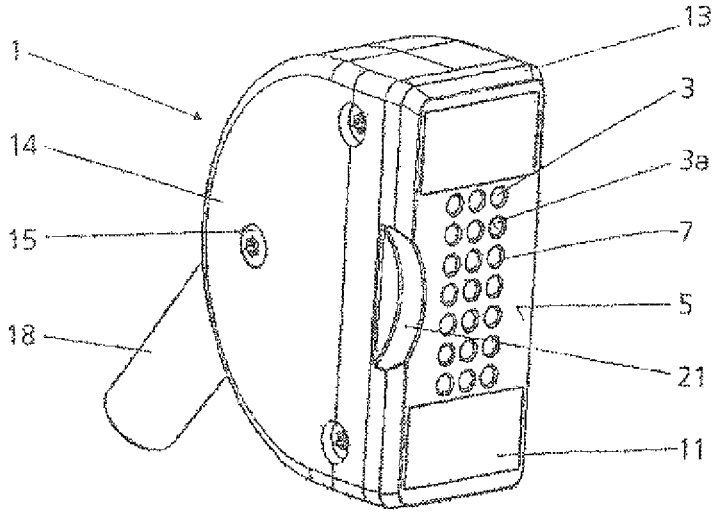
FIG. 2 shows a perspective plan view of a plug from the front.

In the exemplary embodiment, the contact elements 3 and the mating contact elements 4 make contact over an area by means of their mutually aligned contact surfaces 3*a* and mating contact surfaces 4*a*, when the plug 1 is magnetically connected to the socket 2. For this purpose, in the exemplary embodiment, as is evident in particular from FIG. 2, the contact surfaces 3*a* in the plug 1 are slightly recessed or set back with respect to the front face 5 of the plug 1, and the mating contact surfaces 4*a* project slightly beyond the front face 6 of the socket 2 (not illustrated), in such a way that, when the plug 1 is connected to the socket 2, the mating contact surface 4*a* penetrates slightly (for example 1 to 3 mm) into respectively associated depressions in the front face 5 of the plug 1, before the mating contact surfaces 4*a* rest over an area on the contact surfaces 3*a* of the plug 1.

As is also evident from FIG. 1, the magnets 10 can be held in the socket 2 by adhesive bonding, clamps or clips. Furthermore, the connection elements 11, which are not permanently magnetic, can likewise be held in the plug 1 by adhesive bonding, clamps or clips. Appropriate solutions for this purpose are available from the general prior art.

As is also evident from FIGS. 1 to 4, a housing 12 of the plug 1 can preferably be formed essentially by three elements, specifically by a front part 13, which also forms the front face 5 of the plug, and two side parts 14. The plug 1 can preferably be assembled by the side parts 14 being screwed to one another by means of screws 15, with the front part 13 also being attached during this process, for example by means of dovetail connections—in each case between the front part 13 and an adjacent side part 14. The front part 13 preferably has at least one dovetail connection (or a part thereof) on each of its four side surfaces (that is to say the two short sides and the two long sides of the rectangle) thus making an interlocking, mechanical connection with a correspondingly designed, adjacent contact surface on a side part 14. The connection can in this case be fixed by means of a screwing connection for the side parts 14.

The housing 12 of the plug 1 can preferably be formed from plastic. The socket 2 can preferably be formed from a plastic, with the front face 6 of the socket 2 preferably being formed integrally with an area of the socket 2 which holds the magnets 10.

Figure 5:
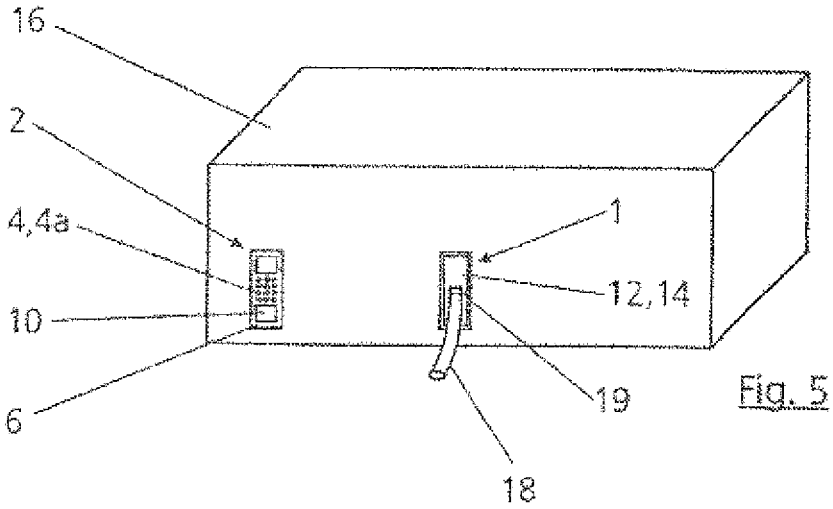
FIG. 5 shows an outline illustration of an electronic appliance with two sockets as part of the electrical connection system according to the invention.

The socket 2 can be integrated in a known manner, and/or using known means, in a preferred manner in an electronic appliance 16, as illustrated by way of example in FIG. 5.

In the exemplary embodiment, the connection element 11, which is not permanently magnetic, is a soft-magnetic material, in particular a soft-iron core.

FIG. 1 shows a refinement of the housing 12 of the plug 1 with a kink protection sleeve 17, which is suitable for surrounding a cable outlet 18 such that the cable outlet 18 is connected mechanically and in an interlocking manner to the housing 12, to be precise to the side parts 14 which form the housing 12 in this area. For this purpose, the cable outlet 18 has a projection or a web and a recess, which can be connected in an interlocking manner to a suitable recess or a suitable groove in the side parts 14. This results in a mechanical connection, which cannot rotate, between the cable outlet 18 and the housing 12. A kink protection sleeve such as this is a known refinement for plugs 1, and is therefore not annotated more specifically in FIG. 1.

Figure 3:
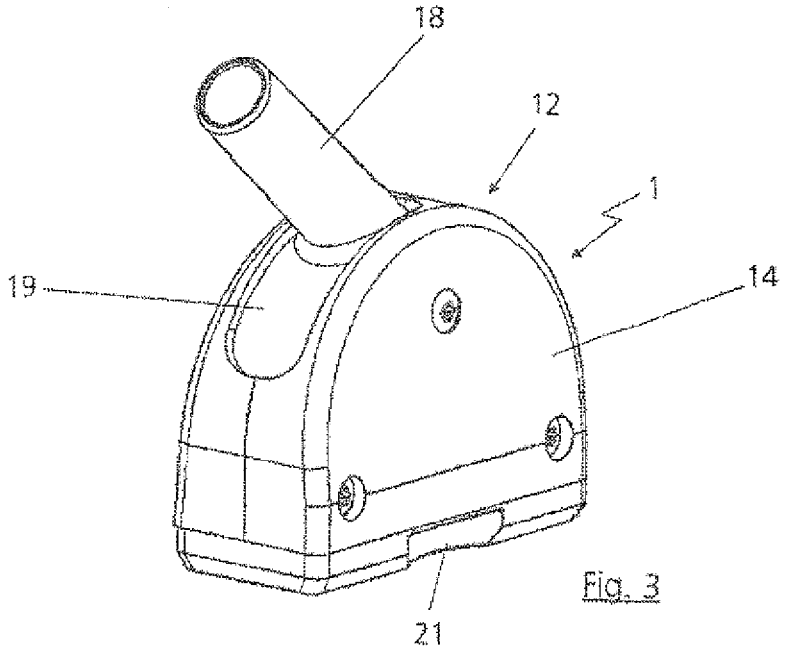
FIG. 3 shows a side view of a plug, in a refinement with a rotating joint.

FIG. 3 shows an alternative, advantageous connection of the cable outlet 18 to the housing 12 of the plug 1. For this purpose, the plug 1 has a rotating joint 19 or a hinge, via which the cable outlet 18 is connected to the housing 12 of the plug 1. The cable outlet 18 can therefore carry out a pivoting movement with respect to the housing 12.

Figure 4:
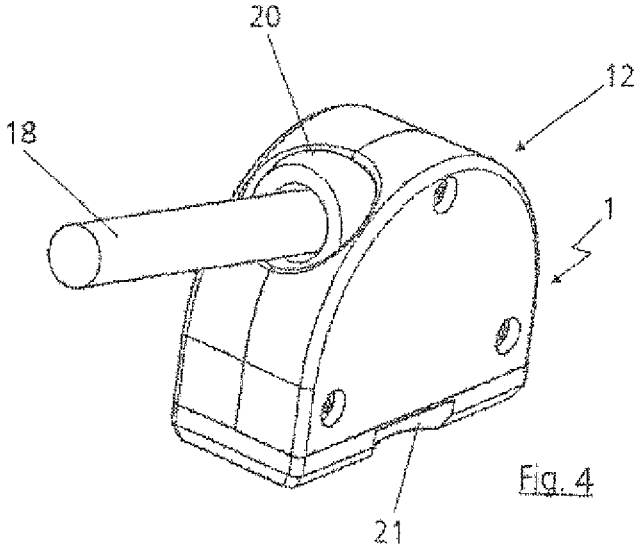
FIG. 4 shows a side view of a plug, in a refinement with a ball joint.

FIG. 4 shows an alternative refinement, in which a ball joint 20 is provided instead of a rotating joint 19 and surrounds the cable outlet 18 such that the cable outlet 18 is connected, such that it can move, to the housing 12 of the plug 1. The cable outlet 18 can therefore carry out a pivoting movement, and possibly also a rotating movement, with respect to the housing 12.

As is also evident from FIGS. 1 to 4, the plug 1 and the socket 2 may have mechanical coding 21. In this case, FIGS. 1 to 4 illustrate the mechanical coding 21 on the plug 1. This is in the form of a depression 21 on the front face 5 of the plug 1 in the area of an edge of the front face 5 of the plug 1. The socket 2 may in this case have a projection (not illustrated) which corresponds to the depression 21 in the plug 1, thus ensuring the plug 1 can be fitted to the socket 2 only in such a way that its projection engages in the depression 21 in the plug 1. In principle, a plurality of mechanical codings may also be provided.

The plug 1 may, of course, also have a projection, and the socket 2 a corresponding depression.

FIG. 5 shows an electronic appliance 16 which is preferably an electronic, medical appliance (or component) which is used in a medical care facility, in particular in a hospital. FIG. 5 illustrates a socket 2 having two magnets 10 which form a part of the magnet device 9 for connection to a plug 1. Furthermore, a second socket 2 is provided in the appliance 16 shown in FIG. 5. A plug 1 has already been fitted to this socket 2, thus concealing the socket 2.

While the invention has been described with reference to various preferred embodiments, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed but that the invention will include all embodiments falling within the scope of the appended claims, either literally or under the Doctrine of Equivalents.

What is claimed is:

1. An electrical connection apparatus, comprising:

a socket having a first front face, a permanently magnetic first magnet located on a first side of said first front face, a permanently magnetic second magnet located on a second side of said first front face, and a plurality of first electrical contact elements disposed between said first magnet and said second magnet; each of said first electrical contact elements having a respective first contact surface projecting from said first front face;

a plug having a second front face, a plurality of second electrical contact elements, a cable outlet, a first magnetic connection element located on a first side of said second front face, a second magnetic connection element located on a second first side of said second front face, said second front face including a plurality of depressions disposed between said first magnetic connection element and said second magnetic connection element, said first magnetic connection element and said second magnetic connection element each being magnetically attractable but not permanently magnetic, each of said second electrical contact elements having a respective second contact surface disposed in a respective one of said depressions, said plug and said socket being detachably mateable to one another by magnetic attraction of said first magnet with said first magnetic connection element and magnetic attraction of said second magnet with said second magnetic connection element to make a plurality of electrical connections, each of said electrical connections being made within a respective one of said depressions through contact of each of said first contact surfaces with a respective one of said second contact surfaces.

2. An electrical connection apparatus according to claim 1, wherein said plug and said socket are detachably mateable to one another exclusively by magnetic attraction of said first magnet with said first magnetic connection element and magnetic attraction of said second magnet with said second magnetic connection element.

3. An electrical connection apparatus according to claim 1, wherein the magnet device has two or more pairs of connections.

4. An electrical connection apparatus according to claim 1, wherein said first magnetic connection element is of a soft-magnetic material.

5. An electrical connection apparatus according to claim 1, wherein said first magnetic connection element is formed by a soft-iron core.

6. An electrical connection apparatus according to claim 1, wherein said first magnet and said second magnet are held in said socket by adhesive bonding, clamps or clips and/or said first magnetic connection element and said second magnetic connection element are held in said plug by adhesive bonding, clamps or clips.

7. An electrical connection system apparatus according to claim 1, wherein said plug further comprises a housing and a joint connecting said cable outlet to said housing, said joint being a pivoting joint or a rotating joint.

* * * * *